United States Patent [19]

Maurer

[11] 4,141,282

[45] Feb. 27, 1979

[54] LEVER WITH POWERED ACCESSORY

[75] Inventor: Herman J. Maurer, Terre Haute, Ind.

[73] Assignee: J. I. Case Company, Racine, Wis.

[21] Appl. No.: 795,124

[22] Filed: May 9, 1977

[51] Int. Cl.[2] ..... F15B 9/10; F15B 13/10

[52] U.S. Cl. ..... 91/374; 91/391 R

[58] Field of Search ..... 91/377, 391 R, 374, 91/372, 375

[56] References Cited

U.S. PATENT DOCUMENTS

| | | | |
|---|---|---|---|
| 1,851,274 | 3/1932 | Coates | 91/377 |
| 2,551,273 | 5/1951 | Lisle et al. | 91/377 |
| 3,078,828 | 2/1963 | Heacock | 91/377 |
| 3,180,233 | 4/1965 | Jablonsky | 91/37 X |
| 3,927,602 | 12/1975 | Strouff | 91/372 |
| 3,952,631 | 4/1976 | Strouff | 91/372 |
| 3,978,770 | 9/1976 | Strouff | 91/372 |

*Primary Examiner*—Paul E. Maslousky
*Attorney, Agent, or Firm*—Arthur J. Hansmann

[57] ABSTRACT

A lever with a powered accessory for forcing against a resistance so that an initial manual operation can be applied to the lever and subsequently a powered force will be applied to the lever. The powered apparatus is shown to be a fluid cylinder assembly attached with the lever for assisting the pivot of the lever, and linkage attaches to the lever and extends to a valve or the like which is to be operated and which presents the resistance to be overcome. Fluid switches are disposed adjacent the lever and are activated according to the initial pivoting of the lever for controlling the flow of fluid to the cylinder assembly and thus to achieve the power assist in the pivot of the lever and the actuation of the resisting valve.

1 Claim, 2 Drawing Figures

FIG. 2
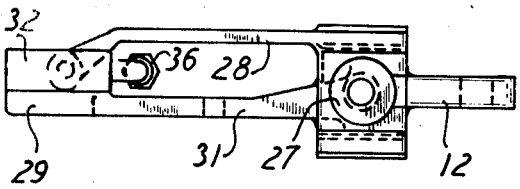
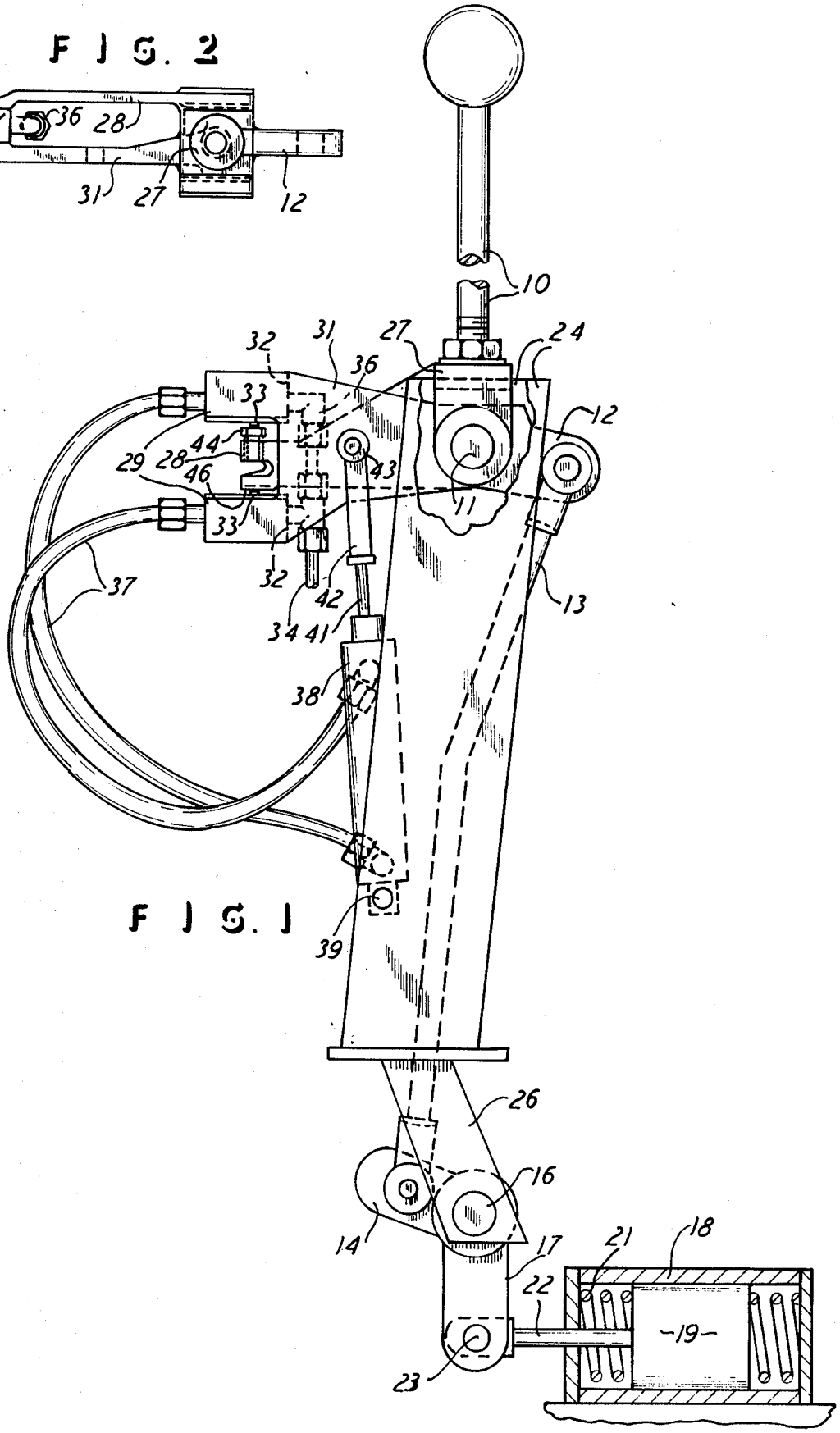
FIG. 1

LEVER WITH POWERED ACCESSORY

This invention relates to a lever with a powered accessory, and, more particularly, it relates to an arrangement of a manually operated lever having a powered apparatus connectable with the lever for assisting the actuation of the lever and thereby overcoming some of the resistance which the lever is intended to overcome.

BACKGROUND OF THE INVENTION

It is common to provide levers with various arrangements for mechanical advantage so that a minimum amount of force is required to achieve the pivot of a lever and to thus accomplish the desired work or actuation for controlling mechanical apparatus or for like purposes. In those arrangements, it is very common to employ a long lever for maximum torque and having a short lever arm so that a minimum of force is required by an operator to manually manipulate that type of lever. However, the physical limitations on the length of the lever arm, and the limitations on the amount of space and material available for the lever arm enter into the considerations for making a long lever arm. That is, there are requirements for the employment of levers where it is desirable that the operator not be required to exert a considerable force in order to accomplish the desired work through the lever, and such considerations are also important where repeated lever action is required and operator fatigue is a factor.

Further, powered types of levers are commonly used in the mechanical arts, and such use no doubt could be in the nature of a powered apparatus which is controlled through a control of the flow of the energy or power to the apparatus itself which in turn causes the lever or linkage to move and thus actuate the mechanism, all as desired. However, in that type of installation, the powered apparatus would be the complete and sole control of the lever or linkage, and the operator would have no means of sensing the exact degree of actuation of the mechanism and would therefore lose control in the human sensing of exactly what action the lever is undertaking.

Accordingly, the present invention provides an arrangement for a lever wherein both manual and powered force is applied to the lever and against a resistance, for achieving the work or action at the point of the resistance, such as in the actuation of a valve which has an inherent resistance which must be overcome before actuation occurs. That is, a valve of the spool type has return springs and also internal pressures which resist the movement of a control lever, and normally the operator is required to manually overcome that resistance, rather than have any powered apparatus to over-come the resistance in conjunction with manual control.

Therefore, the present invention provides a lever with a powered accessory which is used to reduce the manual effort required to actuate mechanisms having large resistances or which require frequent actuation against a resistance and thus induce operator fatigue.

Further, it is an object and advantage of this invention to accomplish the aforementioned and to do so with an arrangement of a manually controlled lever having a powered accessory and with the entire arrangement being such that the lever can be retained in a set operative position without necessarily requiring the hand contact by the operator, and the lever can also be readily returned to a neutral position and retained in that position.

Other objects and advantages will become apparent upon reading the following description in light of the accompanying drawings.

BRIEF DESCRIPTION OF THE DRAWINGS

FIG. 1 is a side elevational view of an embodiment of this invention.

FIG. 2 is a top plan view of a portion of FIG. 1.

DETAILED DESCRIPTION OF THE PREFERRED EMBODIMENT

The drawings show the assembly having the manually controlled lever 10 which is manipulated by the operator and the assembly has a pivot mounting pin 11 and an extension 12. A link 13 pivotally connects with the extension 12 and extends downwardly to a crank 14 pivotally mounted on a pin 16, and the crank 14 has an arm 17 which is shown connected with a valve 18 which is to be controlled by the operator. The valve 18 may be of a conventional spool type arrangement having a spool 19 and end springs 21 and a spool shaft 22 which pivotally connects with the crank arm 17 through a pin 23. The drawing does not show the conventional fluid ports for the shown spool valve 18, but those ports could be in the broken away and therefore unshown portion of the valve 18. Also, the drawings show spaced-apart frame pieces 24 which provide support for the pivot pin 11, and a lower frame piece 26 provides support for the crank pivot pin 16.

Thus, upon manipulating the handle or lever 10, the linkage 13 and 14 will position the valve 18 for actuation of the spring-biased valve 18, as desired. The arrangement is somewhat conventional, and it will be understood that a significant force is required on the lever 10 in order to actuate the valve 18, and it is the overcoming of the resistance presented by the valve 18 which creates the desirability and need for the power assist in the actuation of the lever 10.

FIGS. 1 and 2 actually show that the lower end of the lever 10 connects with a hub 27 pivotally mounted on the pin 11, and the hub has an extending arm 28. The arm 28 has its extending end disposed between two spaced-apart legs 29 of pivot member 31 of which the portion 12 is a part. That is, the lever arm 28 extends into a position for contacting the member 31 and to thus pivot the member 31 about its pivot mounting on the pin 11 and to therefore displace the portion 12 of the member 31 and thus actuate the linkage connected to the valve 18, as mentioned.

Two air switches or valves 32 are mounted on the extending arms 29 of the member 31 and they are in the path of movement of the lever arm 28. The switches 32 have actuation buttons 33 which are therefore contacted by the arm 28 to position the switches 32 in open and closed positions, depending upon the movement of the lever 10. The switches 32 are normally closed, and they will of course open and be actuated when the arm 28 is alternately moved against the switch buttons 33 for actuating the switches, and those switches are of a standard design and construction and may be model MV2 supplied by the Air-Mite Company of Chicago, Illinois. See, also, U.S. Pat. No. 3,433,267.

An air line supply hose or connection 34 extends from an unshown source of supply of pressurized air and into the connections 36 affixed to the arm 29 and leading into connection with the respective switches 32, as shown in FIG. 1. Also, air lines or hoses 37 are suitably connected with the switches 32 and can conduct the flow of air from the switches 32 and to an air cylinder 38 which is pivotally mounted on a pin 39 supported on the frame pieces 24. The cylinder assembly 38 has a rod 41 which extends to fork 42 which in turn is pivotally connected with the arm 31 by means of the pin 43.

With the shown and aforementioned arrangement, movement of the arm 28 by moving the lever 10 will cause the arm 28 to engage either of the switch buttons 33 which in turn will activate the switches 32 by opening the switch and allow air to flow from the supply line 34 and into the respective line 37 and thus to the double-acting cylinder assembly 38. As such, the extension or retraction of the cylinder assembly rod 41 will be imposed upon the arm 31 and that will produce a power assist in the actuation of the linkage 13 and 14 connected with the resistance or spring-biased valve 18, or whatever mechanism is to be operated. With that arrangement, the operator will always feel some of the resistance in the lever or handle 10, and he will therefore be able to sense the movement and position of the lever 10 and the linkage connected to the mechanism being actuated, such as the valve 18. However, the operator may supply a hand force of say only six pounds, but the total force produced by the power assist and the hand lever may be at least as much as twenty pounds.

Also, an adjusting screw 44 extends into the arm end 28 and aligns with the one switch button 33, as shown in FIG. 1, and thus the distance between the top head of the screw 44 and the side 46 of the arm 28 can be aligned, and that is relative to the distance between the two switch buttons 33. Therefore, a slight lost motion connection can be established between the arm 28 and the switch buttons 33, so the operator can move the lever 10 in either the forward or reverse direction and thereby be actuating one of the switches 32 while the other switch is returned to its normally closed or inactive position, all as desired.

As such, the assembly 38 provides powered apparatus which is connectable with an energy supply, and the switches 32 provide actuatable release mechanism for releasing the energy supply to the powered apparatus. Also, the manually operative lever 10 and the release mechanism of the switches 32 are operatively associated together so that the operator can be sensing the resistance at the same time that he is receiving the power assist from the powered apparatus 38. Of course it will also be understood that with the double acting cylinder assembly 38, the switches 32 are arranged to permit that double acting by presenting pressure at one end of the cylinder assembly 38 while relieving it at the other end of the cylinder assembly 38, such as with these conventional switches 32, as previously disclosed. Further, the operator can actuate the mechanism to a certain degree of pivot of the lever 10 and corresponding displacement of the linkage 13 and 14 and he can leave it in that position until the lever 10 is retracted and the switches 32 are reversed in their action.

What is claimed is:

1. A lever with an air-powered accessory for forcing against a resistance, comprising a support member, a pivot pin on said support member, a lever pivotally mounted on said pivot pin and adapted for manual initial manipulation and being movable in two opposite directions, a member pivotally mounted on said pivot pin and disposed adjacent said lever, said member having two portions disposed on opposite sides of said lever to be contacted thereby in the respective paths of said two directions of movement of said lever and being in a lost motion relation with said lever whereby pivoting of said lever also pivots said member, an air-powered cylinder assembly attached to said member and being extendable and contractible for pivoting said member when said air-powered cylinder assembly is energized, a pressurized air connection connected with said air-powered cylinder assembly, two air valves operatively connected with said air connection and said air-powered cylinder assembly for releasing pressurized air to said air-powered cylinder assembly, said air valves being mounted spaced apart on said member on the respective two portions thereof to be respectively disposed in the two paths of movement of said lever in said lost motion relation with said lever and being operated in response to said manipulation of said lever for energizing said air-powered cylinder assembly and apply it against the resistance.

* * * * *